United States Patent [19]

Stutzman

[11] 4,391,570

[45] Jul. 5, 1983

[54] APPARATUS FOR COOLING A CEILING MOUNTED FAN MOTOR

[76] Inventor: Clarence Stutzman, 1429 Reedsburg North, Wooster, Ohio 44691

[21] Appl. No.: 258,669

[22] Filed: Apr. 29, 1981

[51] Int. Cl.[3] ..... F04B 17/00; F04B 35/04

[52] U.S. Cl. ..... 417/353; 416/93 R; 416/170 R; 310/62

[58] Field of Search ..... 417/353, 354; 310/62, 310/63, 58, 59, 74, 153, 90; 416/93 R, 175 R, 170 R, 5

[56] References Cited

U.S. PATENT DOCUMENTS

| | | | |
|---|---|---|---|
| 997,678 | 7/1911 | Jalonick | 416/170 R |
| 2,327,841 | 8/1943 | Hagen | 416/170 R X |
| 4,064,427 | 12/1977 | Hansen et al. | 415/121 G X |

*Primary Examiner*—Carlton R. Croyle
*Assistant Examiner*—Donald E. Stout
*Attorney, Agent, or Firm*—Hamilton, Renner & Kenner

[57] ABSTRACT

An apparatus (10) for cooling a ceiling mounted room fan motor (11) having a rotatable shaft (24) and a motor housing (12) includes a flywheel (13) supported upon and rotating with the shaft (24) and a fan assembly (14). Motor housing (12) has a cylindrical side (15) and substantially circular end plates (18, 19) which together completely seal all windings of fan motor (11) therewithin and preclude entry of and contamination by environmental particulate pollutants. Fan assembly (14), similar to that of a squirrel cage fan, is substantially cylindrical, surrounds motor housing (12), and is operatively connected with flywheel (13) to rotate with the shaft (24), all energy for operation of fan assembly (14) being provided by fan motor (11).

8 Claims, 2 Drawing Figures

APPARATUS FOR COOLING A CEILING MOUNTED FAN MOTOR

TECHNICAL FIELD

The present invention relates generally to enclosed motors subjected to higher ambient temperatures. More particularly, the present invention concerns the cooling of enclosed motors subject to higher temperature environments. Still more specifically, the present invention relates to cooling of a ceiling mounted motor, as is frequently utilized in ceiling mounted fans and combined fan and light fixtures, where all motor windings are completely enclosed within the motor housing.

BACKGROUND ART

Numerous motor applications require enclosure of the motor windings and operation in an environment in which significant concentrations of heat arise. In many of these applications deleterious particulates as dust are present in the environment from which it would be most beneficial to shield the motor windings. Typical of such applications are the use of ceiling mounted motors to operate ceiling mounted room fans and combined fan and lighting fixtures.

When a motor is forced to operate in a high temperature and "dirty" environment, among other things the motor may consume more power, and its working lifetime reduced. Additionally, the insulation on the winding conductors can be damaged or destroyed, possibly precipitating a fire. Ceiling mounted room fans, in particular, begin circulating warmer air, offsetting and defeating gains made in cooling the room by moving the otherwise stagnant air therein.

One solution to elimiate particles from collecting on the motor windings is to completely seal the same inside a housing. But since enclosing the windings of a motor within a housing significantly increases the motor operating temperature resulting in the above mentioned difficulties, historically motors have incorporated somewhat randomly placed holes in the motor housing through which environmental air may pass. However, these holes still permit the build-up of dust and other adverse particlates upon the motor windings. Moreover, the cooling produced by this method is very minimal because relatively little, if any, air ultimately finds its way through the motor.

More recently some manufacturers of blower fans for commercial furnaces have mounted the fan motor partially within the fan blade assembly such that air is rapidly drawn from one end of the motor through openings in the motor housing. Not only does this technique accelerate the collection of dirt inside the motor housing, but heat removed from the motor is collected by the fan and circulated with the main airflow. Although this may be acceptable in the context of furnaces for heating, leaving the motor housing open and circulating the motor generated heat with the main airflow of a ceiling mounted fan increases motor maintenance requirements, reduces its working lifetime, and perhaps most significant serves to add heat to the mainstream of air generated by the fan.

DISCLOSURE OF INVENTION

It is, therefore, an object of the invention to provide an apparatus for cooling motors in which the motor windings may be completely sealed within the motor housing.

It is another object of the invention to provide an apparatus for cooling motors having its windings enclosed within the motor housing in which a substantial volume of cooling air is drawn over the surface of the motor housing, the cooling air first directed to areas of high heat generation.

It is still another object of the invention to provide an apparatus for cooling motors having its windings enclosed within the motor housing, as above, in which a fan is provided surrounding the motor housing for drawing cooling air from the vicinity of both ends of the motor across both respective ends of the motor and the side of the housing, and forceably discharging the cooling air laterally away from the side of the housing.

It is yet another object of the invention to provide an apparatus for cooling motors having its windings enclosed within the motor housing as above, in which the fan has a plurality of fan blades whose longitudinal axis parallels that of the motor shaft, and which fan blades are perpendicularly fixed between two parallel, flat annular discs.

It is a further object of the invention to provide an apparatus for cooling motors having its windings enclosed within the motor housing, as above, in which all energy for operating the fan is derived from the motor it is cooling.

It is still a further object of the invention to provide an apparatus for cooling motors having its windings enclosed within the motor housing as above, in which a flywheel is provided supported upon and rotating with the motor shaft, the fan operatively connected to rotate with the flywheel.

These and other objects and advantages of the present invention over existing prior art forms will become more apparent and fully understood from the following description in conjunction with the accompanying drawings.

In general, an apparatus for cooling a motor having a housing within which all windings are enclosed, includes a fan for drawing cooling air from the vicinity of both ends of the housing across the ends and the sides of the housing, and forceably discharging the cooling air laterally away from the side of the housing.

PREFERRED EMBODIMENT FOR CARRYING OUT THE INVENTION

Figure 1:
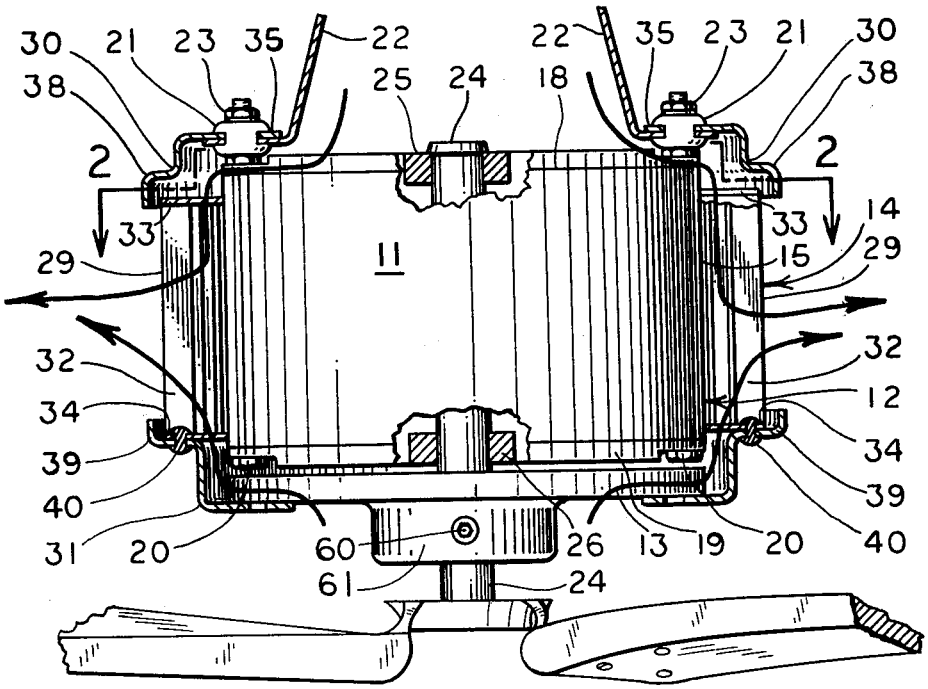
FIG. 1 is an elevational view taken substantially along the line 1—1 of FIG. 2 and depicting an apparatus embodying the concepts of the present invention for cooling a ceiling mounted fan motor having a housing within which all windings are enclosed.

FIG. 1 illustrates an apparatus generally indicated by the numeral 10, for cooling a ceiling mounted fan motor having its windings enclosed within a motor housing. Apparatus 10 includes fan motor 11 whose windings are enclosed within a motor housing 12, a flywheel 13, and a motor fan assembly 14. Motor housing 12 includes a substantially cylindrical side 15 and substantially circular top and bottom plates 18, 19 which together completely seal the motor windings within housing 12 and thereby preclude the entry of and contamination by environmental particulate pollutants. Housing 12 is secured by carriage bolts 20 which extend through housing 12, vibration-limiting rubber grommets 21 and the arms of suspension bracket 22, and are secured by nuts 23.

Fan motor 11 includes a shaft 24 axially secured within housing 12 by two end bearings 25, 26 respectively proximate to top and bottom plates 18, 19. Flywheel 13 is supported upon and rotates with shaft 24, and is secured to shaft 24 by set screw 60 in central hub 61.

Figure 2:
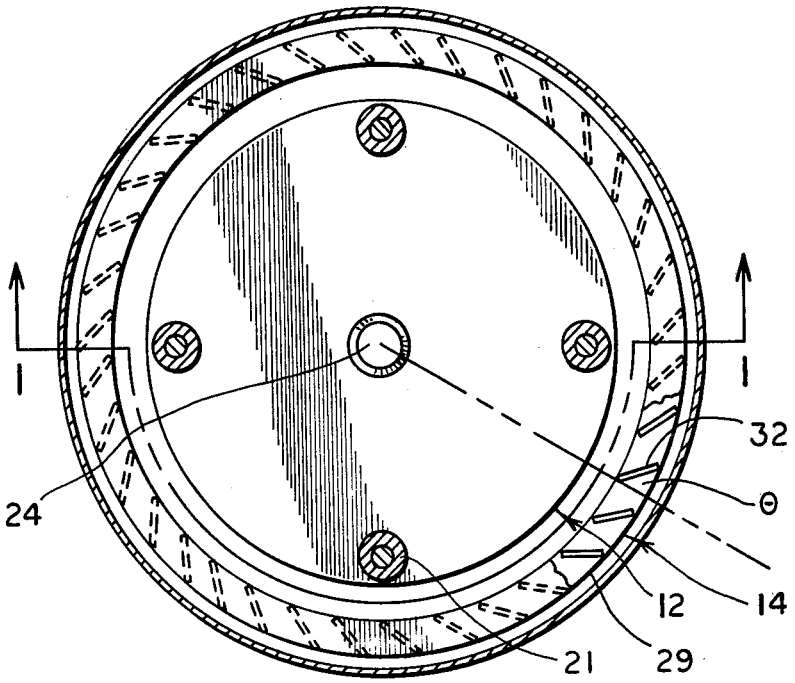
FIG. 2 is a horizontal sectional view taken substantially along the line 2—2 of FIG. 1 and illustrating in particular the plurality of squirrel cage fan blades pitched relative to radial planes emanating from the center of the motor.

Motor fan assembly 14 includes squirrel cage fan drum 29, annular top cap 30 and annular bottom cap 31. Squirrel cage fan drum 29 is substantially cylindrical and of slightly greater diameter than that of housing side 15 such that it may be spatially positioned surrounding housing side 15. Squirrel cage fan drum 29 includes a plurality of fan blades 32 whose longitudinal axis is parallel to that of motor shaft 24, and which fan blades are perpendicularly fixed by any suitable means between two parallel, flat annular discs 33, 34. As seen in FIG. 2, the plane of each fan blade 32 should be angularly oriented with respect to the radial plane passing through the longitudinal axis of fan motor 12 and the radially innermost edge of each fan blade 32. Using aerodynamic techniques well known to the skilled artisan, the precise angle $\theta$ between these two planes should be chosen to maximize the airflow pattern delineated hereinafter.

Annular top cap 30 is overall formed into an annular tier step configuration with a flanged edge 38 extending around disc 33, and includes a plurality of eyelets 35 around its inner periphery into which grommets 21 are placed and which by interference fit maintain annular top cap 30 in fixed spatial relation to motor housing 12 and squirrel cage fan drum 29. Annular bottom cap 31 is formed substantially similar to that of annular top cap 30 and has one end fixed to flywheel 13 by any suitable means as welding. The integrally adjoining step 39 of annular bottom cap 31 acts as a ledge upon which squirrel cage fan drum 29 may be seated and to which the latter is rigidly connected by rivits 40. Configured in this manner squirrel cage fan drum 29 is supported by and operatively connected through annular bottom cap 31 to rotate with flywheel 13. The entire apparatus 10 may be suspended from the ceiling or mounted in any other desired attitudinal position by suspension bracket 22, or any other acceptable means (not relevant hereto).

The operation of apparatus 10 is entirely automatic, inasmuch as squirrel cage fan drum 29 is indirectly, operatively connected to flywheel 13. Whenever shaft 24 is rotating, flywheel 13 and squirrel cage fan drum 29 simultaneously rotate therewith. As squirrel cage fan drum 29 rotates, air is drawn from the vicinity of annular discs 33, 34 across housing side 15 and forceably discharged laterally away from the housing side 15 at substantially its center plane perpendicular to the longitudinal axis of fan motor 12. The close proximity and slightly overlapping edges of annular top and bottom caps 30, 31 respectively, to annular discs 33, 34 results in substantially all the air drawn by squirrel cage fan drum 29 from originating in the vicinity of end plates 18, 19 and being first drawn across the same, as illustrated in FIG. 1 by use of flow arrows.

This air flow pattern produces substantially greater and more efficient cooling of fan motor 12 in that the coolest air is first directed to the vicinity of where the greatest concentration of heat is generated—motor bearings 25 and 26. Indeed, the cooling resulting from this air flow pattern has been found to be so great that motor housing 12 may be completely sealed, eliminating access of particulate pollutants to the motor windings. Moreover, by forcefully discharging the heated cooling air laterally away from the side of the housing, the heat generated by operation of fan motor 11 does not directly enter the air circulation set up by virtually all ceiling mounted fans.

Inasmuch as the present invention is subject to many variations, modifications and changes in detail, a number of which have been expressly stated herein, it is intended that all matter described throughout this entire specification or shown in the accompanying drawings be interpreted as illustrative and not in a limiting sense. It should thus be evident that a device constructed according to the concept of the present invention, and reasonably equivalent thereto, will accomplish the objects of the present invention and otherwise substantially improve the art of cooling motors having their windings enclosed within the motor housing.

I claim:

1. An apparatus for cooling a motor having a housing within which all windings are enclosed, the housing having a substantially cylindrical side and two end plates, each end plate having bearing means mounted centrally therein, the motor having a rotatable shaft journaled in the bearing means, comprising:

annular top cap means in concentrically fixed spatial relation with one of the end plates, annular bottom cap means in concentrically rotatable spatial relation with the other of the end plates, fan means for simultaneously drawing cooling air through the inner peripheries of said top and bottom cap means in the vicinity of said bearing means, across both ends of the housing and the side of the housing and forceably discharging said air laterally away from the side of the housing.

2. An apparatus for cooling a motor, as set forth in claim 1, said fan means being substantially cylindrical and surrounding the housing, and being operatively connected to rotate with said shaft.

3. An apparatus for cooling a motor, as set forth in claim 2, further including flywheel means supported upon and rotating with said shaft, said annular bottom cap means operatively connecting said flywheel means to said fan means.

4. An apparatus for cooling a motor, as set forth in claim 3, wherein all energy for operating said fan means is provided by the motor.

5. An apparatus for cooling a motor, as set forth in claim 4, wherein said fan means includes a plurality of fan blades whose longitudinal axis is parallel to that of said shaft and which said fan blades are perpendicularly fixed between annular disc means.

6. An apparatus for cooling a motor, as set forth in claim 5, wherein the plane of each said fan blade is angularly oriented with respect to the radial plane passing through the longitudinal axis of said shaft and the radially innermost edge of each said fan blade, said plurality of fan blades together with said annular disc means defining a squirrel cage fan blower.

7. An apparatus for cooling a motor, as set forth in claim 6, wherein all the motor windings are completely sealed within the motor housing.

8. An apparatus for cooling a motor, as set forth in claim 7, wherein the motor is ceiling mounted for operating a room fan, said fan means discharging said cooling air such that heat generated by the motor does not directly enter the air circulation flow established in the vicinity of said room fan.

* * * * *